US006280113B1

(12) United States Patent
Gueret

(10) Patent No.: US 6,280,113 B1
(45) Date of Patent: Aug. 28, 2001

(54) APPLICATION DEVICE AND SYSTEM HAVING HELICAL BRISTLES, AND METHOD FOR APPLYING A PRODUCT

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/621,966

(22) Filed: Jul. 21, 2000

(30) Foreign Application Priority Data

Jul. 22, 1999 (FR) ..... 99 09527

(51) Int. Cl.[7] ..... A45D 34/04; A46B 11/00

(52) U.S. Cl. ..... 401/122; 15/206; 15/207.2; 132/218; 401/268

(58) Field of Search ..... 401/122, 269, 401/268; 15/206, 207.2; 132/218

(56) References Cited

U.S. PATENT DOCUMENTS

| | | | | |
|---|---|---|---|---|
| 3,121,040 | * | 2/1964 | Shaw et al. | 15/207.2 X |
| 3,295,156 | * | 1/1967 | Brant | 15/207.2 X |
| 3,344,457 | * | 10/1967 | Grobert | 15/207.2 |
| 4,381,325 | * | 4/1983 | Masuda et al. | 15/207.2 X |
| 4,493,126 | * | 1/1985 | Uy | 15/207.2 X |
| 4,927,281 | | 5/1990 | Gueret . | |
| 4,974,612 | * | 12/1990 | Gueret | 401/122 X |
| 4,993,440 | | 2/1991 | Gueret . | |
| 5,020,551 | | 6/1991 | Gueret . | |
| 5,197,497 | | 3/1993 | Gueret . | |
| 5,309,929 | * | 5/1994 | Toll | 132/218 |
| 5,357,647 | | 10/1994 | Gueret . | |
| 5,491,865 | * | 2/1996 | Gueret | 15/207.2 X |
| 5,567,072 | * | 10/1996 | Dunleavy et al. | 132/218 X |
| 5,588,447 | * | 12/1996 | Gueret | 15/207.2 X |
| 5,588,450 | * | 12/1996 | Gueret | 132/218 |
| 5,657,778 | * | 8/1997 | Gueret | 132/218 X |
| 5,743,279 | * | 4/1998 | Gueret | 401/122 X |
| 5,762,432 | | 6/1998 | Dunleavy et al. . | |

FOREIGN PATENT DOCUMENTS

| | | |
|---|---|---|
| 195 33 815 | 3/1997 | (DE) . |
| 2 607 372 | 6/1988 | (FR) . |
| 2 687 055 | 8/1993 | (FR) . |
| 2 759 872 | 8/1998 | (FR) . |
| 1 053 282 | 12/1966 | (GB) . |
| WO 93/00235 | 1/1993 | (WO) . |
| WO 97/10374 | 3/1997 | (WO) . |

OTHER PUBLICATIONS

English language Derwent Abstract of DE 195 33 815.
English language Derwent Abstract of FR 2 759 872.

* cited by examiner

*Primary Examiner*—Gregory L. Huson
*Assistant Examiner*—Kathleen J. Prunner
(74) *Attorney, Agent, or Firm*—Finnegan, Henderson, Farabow, Garrett & Dunner, L.L.P.

(57) ABSTRACT

An application device includes a stem and an application element on the stem. The application element includes a plurality of bristles. The plurality of bristles includes at least one first bristle having a counterclockwise helical profile over at least a portion of a length of the at least one first bristle and at least one second bristle having a clockwise helical profile over at least a portion of a length of the at least one second bristle. The plurality of bristles can include a plurality of first bristles having the counterclockwise helical profile and a plurality of second bristles having the clockwise helical profile. Also, the plurality of first bristles may have a plurality of different counterclockwise helical profiles, while the plurality of second bristles have a plurality of different clockwise helical profiles.

50 Claims, 9 Drawing Sheets

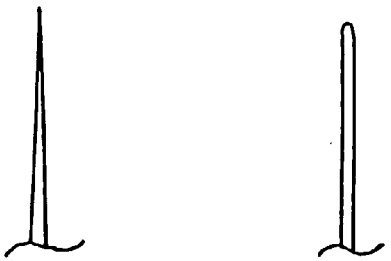
FIGURE 26
FIGURE 27
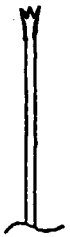
FIGURE 28
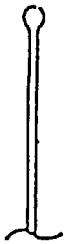
FIGURE 29

APPLICATION DEVICE AND SYSTEM HAVING HELICAL BRISTLES, AND METHOD FOR APPLYING A PRODUCT

The invention relates to an application device equipped with a number of bristles for applying, to a surface such as the skin and its superficial growths, a product of liquid to pasty or pulverulent consistency, for example, a cosmetic or dermatological product. The invention also relates to an application system containing the product and equipped with such an application device.

The present invention can also relate generally to an application system having a reservoir containing the product and equipped with an open end to which a cap is removably attached. The cap acts as a handle, or element for grasping. The cap is secured to an application element, generally by way of a wand, so that when the assembly is closed, the application element remains immersed in the product.

The reservoir is, for example, intended to contain either a make-up product or dermatological product, for example, a mascara, a liquid lipstick, an eyeliner, a powder of the blusher type, nail varnish, or a hair treatment. A dose of this product is withdrawn using such an application device and is applied to the surface that is to be treated.

Many application devices of this type have been proposed in the past with a view toward applying mascara to the eyelashes, varnish to the nails, powder to the cheeks, or dye to the hair.

It is known from FR-A-2,607,372 to produce an applicator in the form of a mascara brush including bristles, each having at least one straight capillary groove at its surface running in a straight line along its entire length. The capillary grooves constitute sites which hold reserves of mascara, allowing swift and effective transfer of the mascara onto the eyelashes at the time of application with a view toward uniform application of the make-up.

In addition, it is known from FR-A-2,759,872 to produce a mascara applicator for eyelashes, comprising a handle of roughly flat profile bearing an application element having of a number of bristles embedded in a first end of the handle in an arrangement that is perpendicular to a plane passing through the handle. The bristles may have a section (or cross-section) in the shape of a cross, a semicircle, or an S. Thus, the bristles have, one or two straight grooves, respectively, at their surface.

Furthermore, FR-A-2,687,055 discloses a nail varnish applicator which has a tuft made of two types of bristles, which bristles may exhibit at least one longitudinal capillary groove.

Another source, WO 97/10374, describes a method of manufacturing twisted fibres of non-circular cross-section obtained by twisting monofilaments about their central axes. The cross-section of the monofilaments is not a cylinder of revolution. This document quotes fibres of oval or polygonal cross-section or monofilaments which have a core with at least one rib extending in a helix about the core of the filament. Such fibres are twisted after extrusion. This document describes the use of these fibres for various kinds of abrasive or cleaning brushes, or alternatively, for toothbrushes.

Although these conventional applicators are, on the whole, satisfactory, it has become desirable to have an application device which makes it possible to achieve a make-up effect which is both very heavy and very uniform, and which dispenses a greater capacity of product than the known applicators. The problem is that the above-mentioned applicators may have the drawback of losing a significant proportion of their load of product, particularly when the application element is subjected to a wringing-out operation prior to application. This drawback can be even more significant when the grooves or capillary grooves of the bristles are scraped along their entire length during this wringing-out operation.

Therefore, an object of the invention is to provide an applicator which, particularly after wringing-out, has a substantial reserve of product. Specifically, the present inventor has discovered that, by combining bristles which have a left-handed helical profile and bristles which have a right-handed helical profile, it is possible to obtain an applicator which has a capacity, in terms of the amount of product it can hold, which is markedly greater than the capacity of a conventional applicator.

Within the meaning of the present invention, bristles with a "left-handed" helical profile are to be understood as meaning bristles whose surface forms at least one pattern which progresses in a helix about a longitudinal axis of the bristles, with a direction of rotation which is counterclockwise, the helical pattern being viewed from the axis of the bristles.

Likewise, bristles which have a "right-handed" helical profile are to be understood as meaning bristles whose surface forms at least one pattern progressing in a helix about a longitudinal axis of the bristles with a direction of rotation in the clockwise direction, the helical pattern being viewed along the axis of the bristles.

The invention is also aimed at controlled application of the product, regardless of the region of the bristles that is brought into contact with the surface to be treated. For example, the invention could be practiced for the application of make-up to the eyelashes or eyebrows, to the lips, to the skin, or to the nails, or to a hair or dermatological treatment.

Another object of the invention is to provide an applicator which remains simple and economical to manufacture and practical to use. Furthermore, when the product to be applied is relatively fluid, the object of the invention is to gain better control over the speed at which the product flows during application.

Another object of the invention includes a mascara brush having bristles which are more heavily laden with mascara than a conventional brush, while at the same time being able to apply the make-up to the eyelashes very evenly.

The present inventor has also observed that the intersection of the lashes with a mixture of bristles with left-handed and right-handed helical profiles, with which a mascara brush is equipped, hugs the shape of all of the lashes of an eyelid. Unlike conventional brushes, a brush such as this allows the entire surface of each eyelash to be coated fully and more uniformly. Thus, when the user applies the brush to her eyelashes, she loads the base of the lashes with mascara across the entire width of the eyelid. Thereafter, by twisting the brush about its central axis, she gradually releases the mascara loaded into the profiles of the bristle over the entire surface of each eyelash, combing out the lashes and separating them. A brush such as this makes it possible to obtain a make-up effect which is simultaneously heavy, uniform, lengthening, and curling.

Yet another object of the invention is of a brush for applying a varnish to the nails and having controlled-flow properties while at the same time having a very high product-retention capacity.

It should be understood that the invention could still be practiced without performing one or more of the objects and/or advantages described above. Still other objects will become apparent from the detailed description which follows.

To achieve those and other advantages, and in accordance with the purposes of the invention, as broadly described herein, one aspect of the invention includes an application device having a stem and an application element on the stem. The application element includes a plurality of bristles. The plurality of bristles include at least one first bristle having a counterclockwise helical profile extending over at least a portion of a length of the at least one first bristle. The plurality of bristles also include at least one second bristle having a clockwise helical profile extending over at least a portion of a length of the at least one second bristle.

In another aspect of the invention, the plurality of bristles includes a plurality of first bristles having a counterclockwise, or left-handed, helical profile and a plurality of second bristles having a clockwise, or right-handed, helical profile. In a further aspect, the first bristles can include a plurality of differing counterclockwise helical profiles and the second bristles can includes a plurality of differing clockwise helical profiles.

Another aspect of the invention provides an application device having at least one of the plurality of bristles with a cross-section which has at least one ridge progressing in a helix about a longitudinal axis of the bristles. The cross-section may be of polygonal shape, for example, square, triangular, or rectangular.

According to another aspect, at least one of the plurality of bristles has a cross-section with at least one hollow portion progressing in a helix about a longitudinal axis of the bristles. The cross-section may be in the shape of a cross or cruciform, a trefoil, a quatrefoil, a hollow oval, a hollow cylinder, a hollow rectangle, a polygon, a hollow polygon, a figure-8, a C, an S, an E, an F, an H, an I, an L, an N, a W, a V, a T, a Y, a star, or a crescent.

In a further aspect of the invention, the hollow portion is formed on the surface of the bristles. When the hollow portion is formed on the surface of a bristle, it preferably has a dimension in a cross-section of the bristle such that the ratio between the dimension of the hollow portion and the diameter of a circle inside which the cross-section of the bristle lies ranges from 1/10 to 9/10. Alternatively, the hollow portion may be formed inside the bristles.

In yet another aspect of the invention, at least one of the plurality of bristles may have a cross-section with at least one rib progressing in a helix about a longitudinal axis of the bristles.

In further preferred embodiments, the proportion of the number of first bristles to the number of second bristles can vary, for example, from about 2% to about 98%.

According to another aspect, the application element includes at least one tuft of the bristles which are oriented roughly parallel to one another, one end of the tuft being fixed to a stem. When the application element is formed with a single tuft of bristles, it is possible to obtain an application device which is particularly well suited to the application of varnish to the nails, such as a nail varnish brush. An application element such as this may also be shaped as a blusher-type brush allowing a powder to be applied to the face, an eyeliner brush allowing mascara to be applied to the eyelashes, or a lipstick brush.

Some preferred embodiments of the invention include a handle on an end of the stem opposite to the application element. Alternatively, or in addition, at least a portion of the stem could be configured to be grasped by a user during application of a product.

According to one aspect of the invention, a free end of the application element is secured to a support, the application element being arranged in a plane of the support and oriented transversely with respect to a longitudinal axis of the device. This arrangement may preferably be adopted for a device for applying mascara to the eyelashes.

According to a further aspect of the invention, the bristles are oriented approximately radially on the application element with respect to a central core. In this case, the applicator device may be used as a mascara brush or as an applicator for applying hair dye to the hair.

Preferably, a core such as this is formed by twisting together two branches of metal wire in such a way as to trap the bristles between the twisted-together branches of the core. In this case, the brush obtained is one of the "bottle-brush" type. Preferably, the core defines an axis coincident with the axis of the application device.

The applicator device may have varying external shapes. Thus, its profile formed by the ends of the bristles can be tailored to suit, according to the nature of the product to be applied and to the morphology of the support. This profile can be obtained, for example, by trimming the bristles using a trimmer. The application device may comprise a mixture of bristles of a first length and bristles of a second length greater than the first.

Furthermore, all or some of the bristles of the application devices according to the invention may be of any type, with tapered, rounded, forked, or pinhead ends, or may have undergone all kinds of treatments known to those skilled in the art. These bristles may be corrugated in a plane or formed as a stretched-out spiral.

The cross-section of the bristles may preferably lie inside a circle of a diameter ranging between about $6/100_{ths}$ of a mm to about $30/100_{ths}$ of a mm.

Depending on the nature of the application element and that of the product to be applied, the length of the bristles may range from approximately 2 mm to approximately 25 mm. In the case of a brush of the "bottle-brush" type, the length of a bristle is defined by the distance between its two free ends. Even bristles of different lengths, wherein one bristle has a length greater than the length of an adjacent bristle, can be used.

The bristles may be made, for example, of a material comprising at least one of polyethylene, polypropene, ethylene/propylene copolymer, polyamide, polyester, polyvinyl chloride, polytetrafluoroethylene, polyethylene terephthalate, or thermoplastic elastomer.

Preferably, the helical profile of the bristles has a pitch ranging from about 1 mm to about 20 mm, and more preferably from about 1.5 mm to about 10 mm, or even more preferably from about 2 mm to about 9 mm.

In a further aspect of the invention, the helical profile is produced in the form of a groove or of a rib. Preferably, the groove or rib has a depth or height such that the ratio between the depth or height of the groove or rib and the diameter of the circle inside which the cross-sections of the bristles lie is from approximately 1/10 to approximately 9/10. Purely by way of example, the depth of the groove may range from about $2/100_{ths}$ of a mm to about $8/100_{ths}$ of a mm.

Another aspect of the invention provides an application system comprising the application device and a reservoir intended to contain the product to be applied. In an application system such as this, in order to be able to meter out the product correctly and to spread it uniformly onto the application element, there may in some instances be provided a wiper, such as a wringing-out member, preferably situated near the open end of the reservoir. A wiper such as this is intended to meter out the amount of product withdrawn by the application element and spread it out evenly.

As a preference, a wiper such as this is made of an elastomeric material, possibly a foam, and has a passage through which the application element and, as appropriate, a portion of the stem can pass. The passage through the wiper may comprise at least one open or contiguous wiping lip. When the application element is on a flat stem, this passage may be in the form of at least one slit extending across a substantial part of the cross-section of the wiper.

In a preferred embodiment of the invention, the reservoir contains a quantity of a cosmetic product, preferably an eye makeup product such as mascara or a nail treatment product such as nail varnish.

In yet another aspect of the invention, the application system includes a handle on an end of the stem opposite the application element. A portion of the handle may be configured to removably cover an opening in the reservoir.

Another aspect of the invention provides a method of applying a product to a surface region of the body, such as an eyelash, fingernail, toenail, or the like. The method includes providing the application device, placing a product on the application element of the device, and transferring the product from the application element to a surface region. Preferably, the product is an eye makeup product or a nail treatment product.

Apart from the provisions explained hereinabove, the invention may include a certain number of other arrangements which will be dealt with more fully hereinafter with regard to some embodiments which are described with reference to the drawings appended hereto, but which are not in any way limiting. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a side view of an application device according to a first preferred embodiment of the invention;

FIG. 26 is a perspective view of an end portion of a bristle having a first shape;

FIG. 27 is a perspective view of an end portion of a bristle having a second shape;

FIG. 28 is a perspective view of an end portion of a bristle having a third shape; and FIG. 29 is an perspective view of an end portion of a bristle having a fourth shape.

Figure 1:
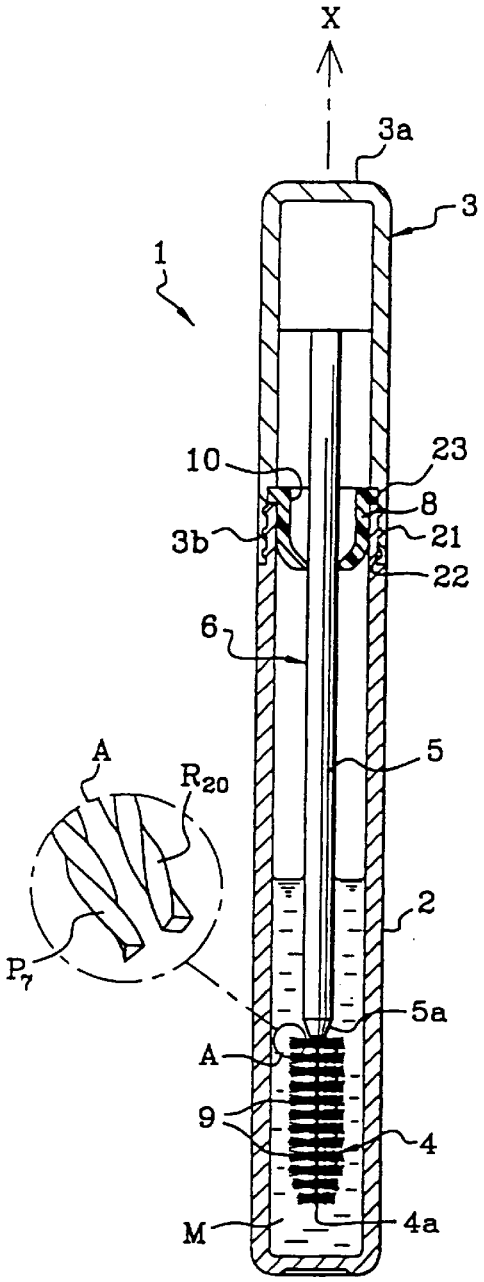

Reference will now be made in detail to the present preferred embodiments of the invention, examples of which are illustrated in the accompanying drawings. Wherever possible, the same reference symbols are used in the drawings and the description to refer to the same or like parts, and the same reference symbols with different numerical subscripts are used to refer to similar parts.

As shown in FIG. 1, a mascara application system 1, of central axis X, for applying a product M contained in a cylindrical reservoir is equipped with an application device. In the embodiment of FIG. 1, an application device 6 includes a cap 3 which can be attached, for example, by screwing, onto the neck 21 of the reservoir 2. The cap 3 includes an outer, upper region 3*a* that can act as a handle, or element for grasping. The neck 21 has an external screw thread 22 capable of cooperating with a complementary screw thread 3*b* formed on the lower portion of the interior surface of the cap 3. The cap 3 is in the overall shape of an elongate cylinder defining a handle easy to hold in the hand.

The cap 3 is equipped with a stem 5 emerging from the cap 3. In the embodiment of FIG. 1, the stem 5 is configured as a wand. This wand 5 has a lower end 5*a* to which an application element 4 is attached, for example, by bonding or by being inset therein.

The neck 21 of the bottle has a free circular edge 23 defining an opening 10. Mounted in this opening is a wiper 8, formed of an elastically deformable material. The wiper, or wringing-out member, is in the form of a thimble, having an end facing towards the reservoir 2. The end is open, so as to form a circular wiping lip capable, as the application device 6 is extracted from the reservoir, of removing excess product from the wand 5 and the application element 4. In the storage position, the wiper 8 has the wand 5 passing through it.

The application element 4 shown in FIG. 1 is a brush for applying mascara to the eyelashes, comprising an elongate core 4*a* formed by twisting together two branches of metal wire bent into a U-shape. The core 4*a* is attached by, for example, force-fitting into the end 5*a* of the wand 5. A great many bristles 9 are implanted radially between the wires of the core 4*a*. When the branches of wire are twisted together, the bristles are trapped and held between the helical turns of the core 4*a*. Detail A of FIG. 1 shows two differing bristles, one of triangular cross-section and the other of square cross-section. In addition, the bristle of triangular cross-section has a left-handed, or counterclockwise, helical profile $P_7$ and the bristle of square cross-section has a right-handed helical, or clockwise, profile $R_{20}$.

The core 4*a* may be centrally positioned, as shown in FIG. 1. In FIG. 1, the core 4*a* defines an axis that coincides with the axis X of the application system. The core may also be off-center with respect to the circle in which the bristles lie. The bristles 9, made of synthetic and possibly flocked fibres, are chosen from bristles such as those illustrated, without any implied restriction, in FIGS. 4 to 25. The application element 4 may include a combination of bristles of differing types, i.e., having differing diameters, shapes, cross-sections, elasticity, materials, and the like. The application element may also have any known exterior shape obtained, for example, by cutting the ends of the bristles 9 using a trimmer.

The application element according to the invention may be heavily laden with mascara. When the application element is placed in contact with the eyelashes, the eyelashes can become heavily laden with mascara. When the user turns the brush about its axis, the lashes continue to be in contact with the application element along substantially their entire length and continue to become laden with mascara, while at the same time being curled. The bristles then begin to comb the lashes. When the user continues to rotate the application element about its axis, the lashes are gripped by the bristles in a region of the helical profile, the orientation of which can vary according to the extent to which the lashes interpenetrate the application element. The mascara product is thus spread out over substantially the entire periphery and along substantially the entire length of each lash. In other words, while the make-up is being applied, the micro-reservoirs formed by the grooves change position with respect to the lash that is to be treated, affording markedly better capacity and allowing the lash to be coated uniformly.

Thus, each lash is loaded substantially uniformly, both along its entire length and around its entire periphery. There is preferably no difference in make-up between the lashes at the end of the eyelid and those in the middle. Preferably, the lashes are perfectly separated from one another, lengthened, and curled.

Figure 2:
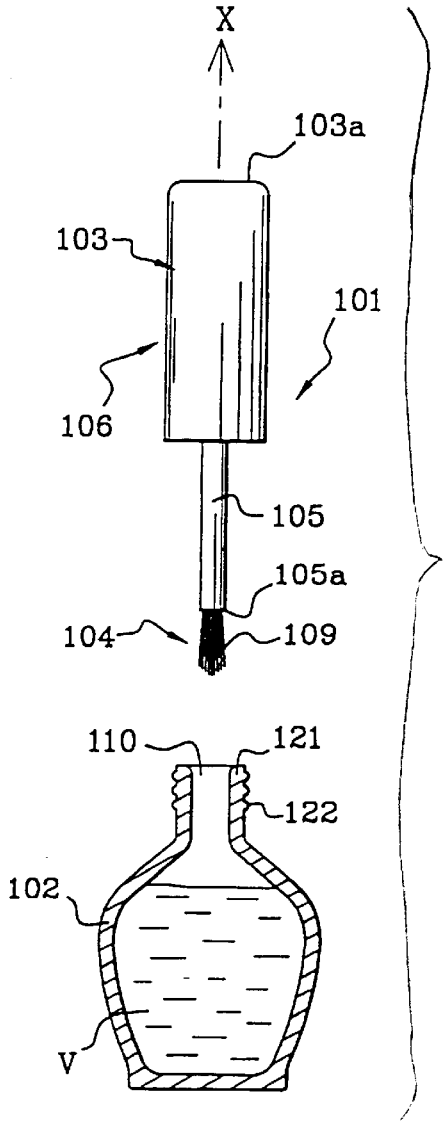
FIG. 2 is a side view of an application device according to a second preferred embodiment of the invention.

FIG. 2 shows an application system denoted overall by the reference 101, comprising a reservoir 102 which has a longitudinal axis X of symmetry and an application device 106 equipped with a grasping collar, or handle, 103. The reservoir 102, preferably made of glass, contains a liquid or viscous product V that is to be applied to a surface region, and which may, for example, be a nail varnish composition.

The reservoir 102 has a neck 121 defining an opening 110. The neck 121 has a screw thread 122 capable of cooperating with a complementary screw thread on the inside of the collar 103. The collar 103 includes an outer, upper region 103*a* that can act as a handle, or element for grasping.

The collar 103 is attached to one end of a stem 105, and the opposite end of the stem 105 is connected to an application element 104. In this particular instance, the application element 104 is formed of a tuft of roughly parallel bristles 109 on a free end 105*a* of the stem 105. In this embodiment, the stem 105 is configured as a wand.

When the application system is closed by screwing the collar 103 onto the reservoir 102, the tuft 104 of bristles 109 dips into the product V. These bristles 109 include bristles with left-handed and right-handed profiles, like those defined earlier. The bristles are preferably chosen from the bristles shown in FIGS. 4 to 25.

When the user wishes to apply some product to a surface region, she unscrews the cap, or collar, 103 and extracts the application element from the reservoir. When the application element holds an excess of product, the user wipes it against the free edge of the neck 121 to wring out any excess product.

It should be noted that the application element preferably remains well laden and has a good ability to hold on to the varnish without forming drops even after a number of wringing-out passes. The varnish may be deposited on the nail at a flow rate which is both reduced and roughly constant. Preferably, the coat of varnish obtained is more even than that obtained with a conventional applicator, and the varnish dries appreciably more quickly.

Figure 3:
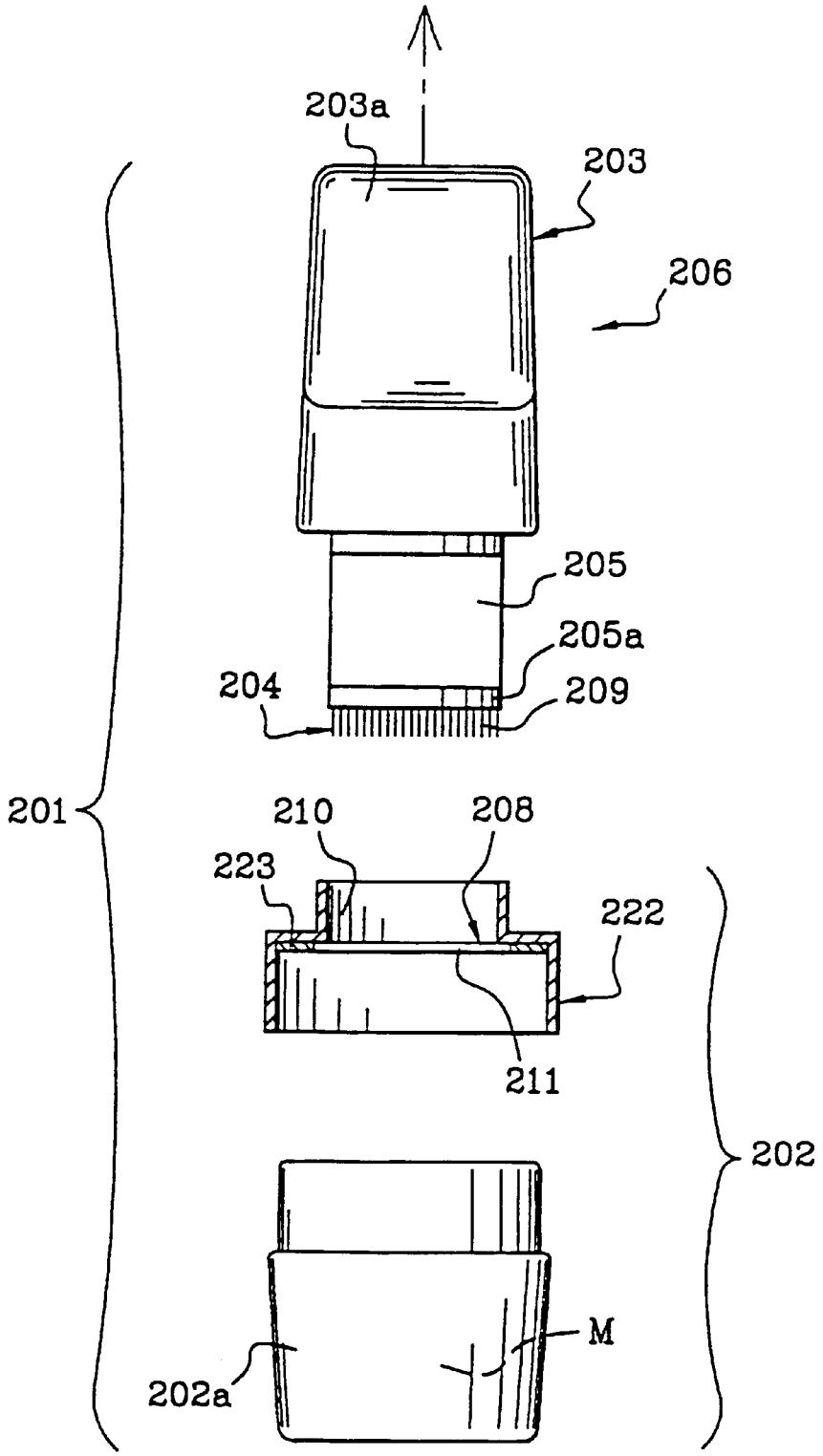
FIG. 3 is a side view of an application device according to a third preferred embodiment of the invention.

FIG. 3 shows an application device 206 in the form of a mascara brush which differs from the one depicted in FIG. 1 in that the stem 205 is configured as a generally flat, planar member. At its free end 205*a*, the stem 205 is connected to an application element 204 having a collection of bristles 209. The application element 204 is arranged in the plane of the stem 205, roughly at a right angle to an axis of the application device 206. The bristles 209 are preferably substantially parallel to the axis of the application device 206, and are of the same kind as those described with reference to FIGS. 1 and 2. The other end of the stem 205 is attached to a collar 203. The collar 203 includes an outer, upper region 203*a* that can act as a handle, or element for grasping.

The mascara brush 206 forms part of a make-up application system 201 including a reservoir 202 containing a product M, surmounted by an element 222 that carries a wiping, or wringing-out, device. The element that carries the wiping device has a neck 210 onto which the collar 203 can be fixed. The element that carries the wiping device also has a shoulder 223, on which a wiper 208 is mounted. In this particular instance, the wiper 208 is formed by an elastomer or foam membrane with a slit 211 through which, as the application device 206 is withdrawn, at least a portion of the stem 205 and the application element 204 of bristles 209 can pass. The plane in which the bristles 209 are implanted may be inclined with respect to the plane passing through the stem 205.

When the application element 206 is extracted from the reservoir, the brush laden with mascara passes through the slit 211 of the wiper 208. The wiping device can thus wring out, i.e., remove excess product from, the outer face of the bristles, while the helical profiles of the bristles retain a significant reserve of product.

When application elements of the invention are subjected to a wiping operation prior to the application of the product, the wiping can be performed randomly. That is, the distribution of the product through the helical profiles is such that micro-reserves of product are present on each bristle at a different position along its length. These micro-reserves are able to ensure that the product is spread out very uniformly along the support that is to be treated.

FIGS. 4 to 25 illustrate particularly preferred bristle configurations for the application elements 6, 106, 206 described hereinabove. Each of these figures depicts a pair of bristles having the same cross-section wherein one bristle of the pair has the left-handed, or counterclockwise, helical profile and the other bristle has the right-handed, or clockwise, profile. The reference letters P and R represent the counterclockwise and clockwise helical profiles, respectively, each subscripted with a numerical reference identifying the particular cross-section. It should be clearly understood that any kind of left-handed bristle can be mixed with any kind of right-handed bristle, as shown in FIG. 1. In FIGS. 4–25, the helical ribs or ridges are indicated by the reference N, and the helical grooves are indicated by the reference G.

Figure 4:
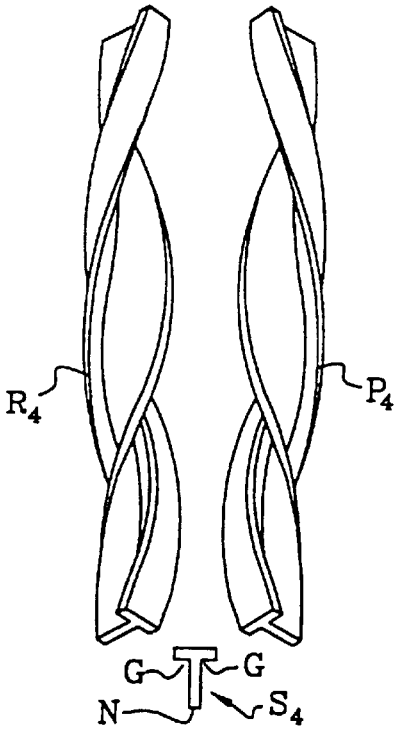
FIG. 4 is a perspective view of two bristles of one of the preferred application devices having a first cross-sectional shape.

FIG. 4 shows two bristles having counterclockwise $P_4$ and clockwise $R_4$ helical profiles, respectively. The cross-section $S_4$ of these bristles is in the shape of a T.

Figure 5:
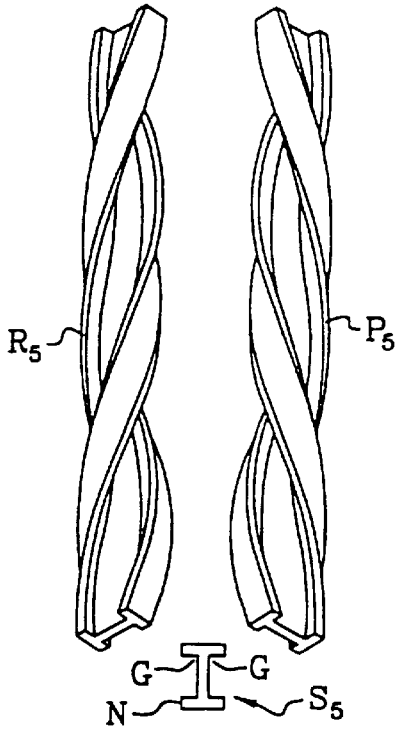
FIG. 5 is a perspective view of two bristles of one of the preferred application devices having a second cross-sectional shape.

FIG. 5 shows two bristles having counterclockwise $P_5$ and clockwise $R_5$ helical profiles, respectively. The cross-section $S_5$ of these bristles is in the shape of an I.

Figure 6:
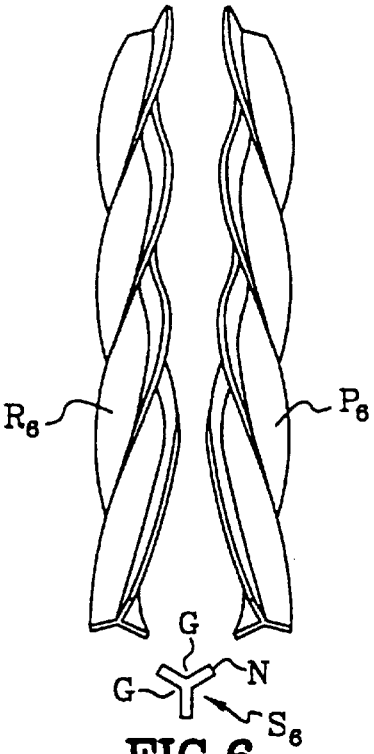
FIG. 6 is a perspective view of two bristles of one of the preferred application devices having a third cross-sectional shape.

FIG. 6 shows two bristles having counterclockwise $P_6$ and clockwise $R_6$ helical profiles, respectively. The cross-section $S_6$ of these bristles is in the shape of a Y.

Figure 7:
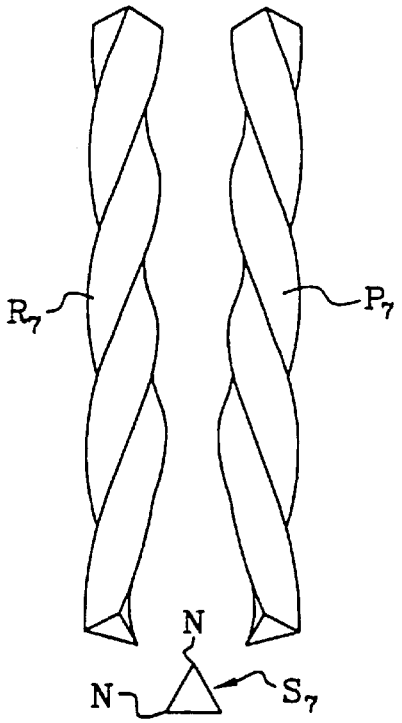
FIG. 7 is a perspective view of two bristles of one of the preferred application devices having a fourth cross-sectional shape.

FIG. 7 shows two bristles having counterclockwise $P_7$ and clockwise $R_7$ helical profiles, respectively. The cross-section $S_7$ of these bristles is in the shape of a triangle.

Figure 8:
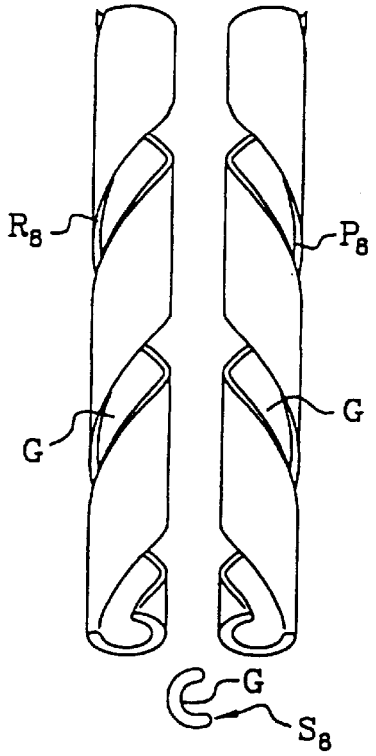
FIG. 8 is a perspective view of two bristles of one of the preferred application devices having a fifth cross-sectional shape.

FIG. 8 shows two bristles having counterclockwise $P_8$ and clockwise $R_8$ helical profiles, respectively. The cross-section $S_8$ of these bristles is in the shape of a C.

Figure 9:
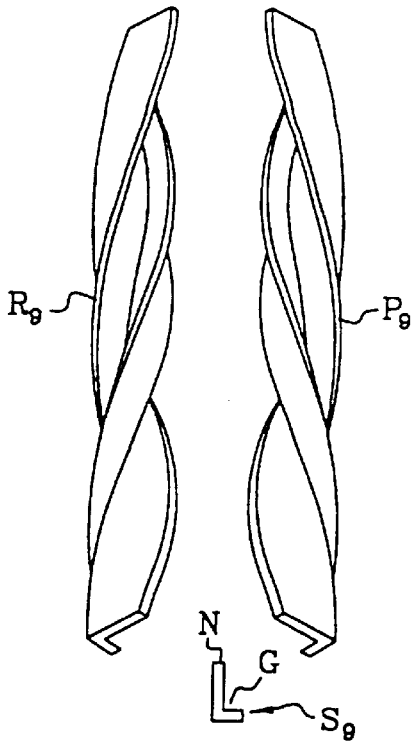
FIG. 9 is a perspective view of two bristles of one of the preferred application devices having a sixth cross-sectional shape.

FIG. 9 shows two bristles having counterclockwise $P_9$ and clockwise $R_9$ helical profiles, respectively. The cross-section $S_9$ of these bristles is in the shape of an L.

Figure 10:
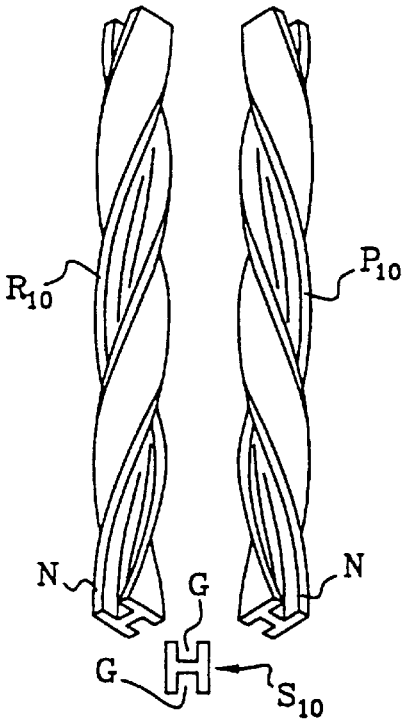
FIG. 10 is a perspective view of two bristles of one of the preferred application devices having a seventh cross-sectional shape.

FIG. 10 shows two bristles having counterclockwise $P_{10}$ and clockwise $R_{10}$ helical profiles, respectively. The cross-section $S_{10}$ of these bristles is in the shape of an H.

Figure 11:
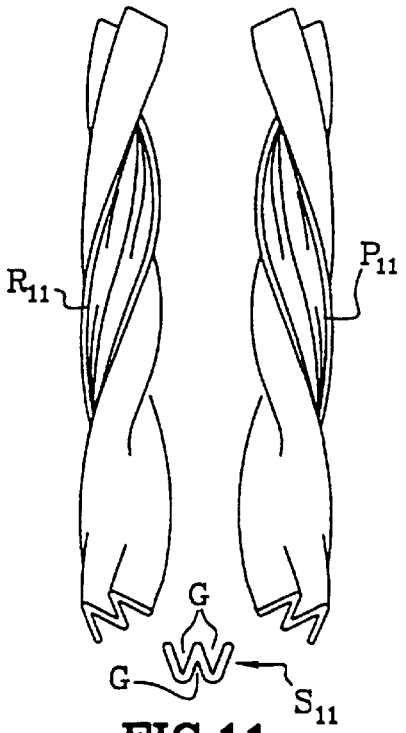
FIG. 11 is a perspective view of two bristles of one of the preferred application devices having an eighth cross-sectional shape.

FIG. 11 shows two bristles having counterclockwise $P_{11}$ and clockwise $R_{11}$ helical profiles, respectively. The cross-section $S_{11}$ of these bristles is in the shape of a W.

Figure 12:
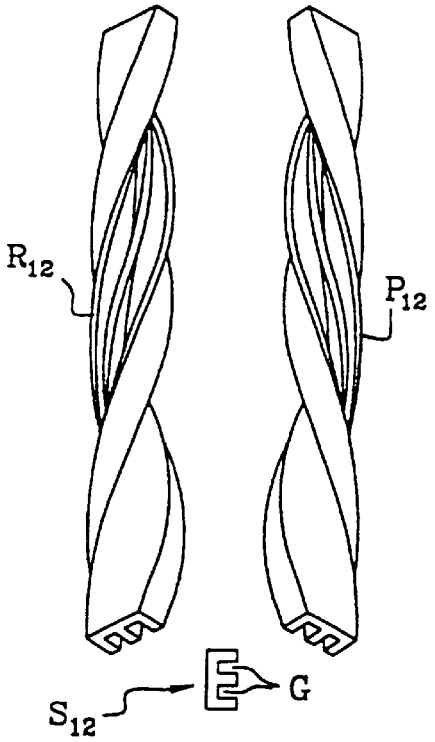
FIG. 12 is a perspective view of two bristles of one of the preferred application devices having a ninth cross-sectional shape.

FIG. 12 shows two bristles having counterclockwise $P_{12}$ and clockwise $R_{12}$ helical profiles, respectively. The cross-section $S_{12}$ of these bristles is in the shape of an E.

Figure 13:
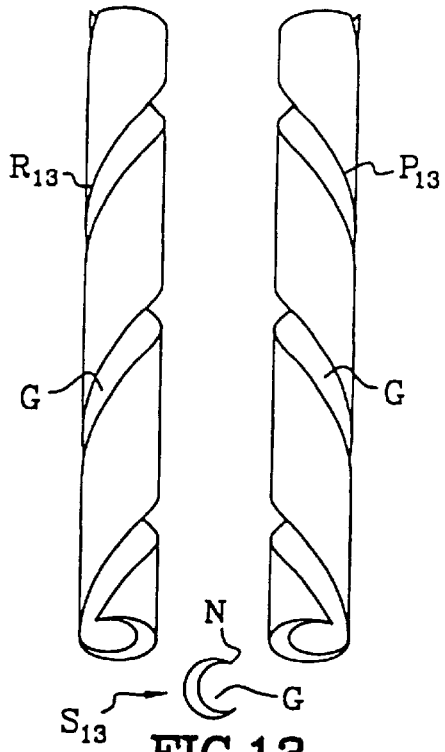
FIG. 13 is a perspective view of two bristles of one of the preferred application devices having a tenth cross-sectional shape.

FIG. 13 shows two bristles having counterclockwise $P_{13}$ and clockwise $R_{13}$ helical profiles, respectively. The cross-section $S_{13}$ of these bristles is in the shape of a crescent.

Figure 14:
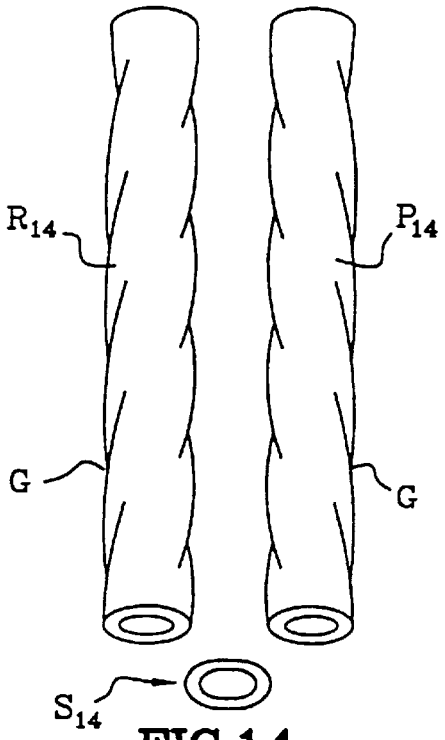
FIG. 14 is a perspective view of two bristles of one of the preferred application devices having an eleventh cross-sectional shape.

FIG. 14 shows two bristles having counterclockwise $P_{14}$ and clockwise $R_{14}$ helical profiles, respectively. The cross-section $S_{14}$ of these bristles is in the shape of a hollow oval.

Figure 15:
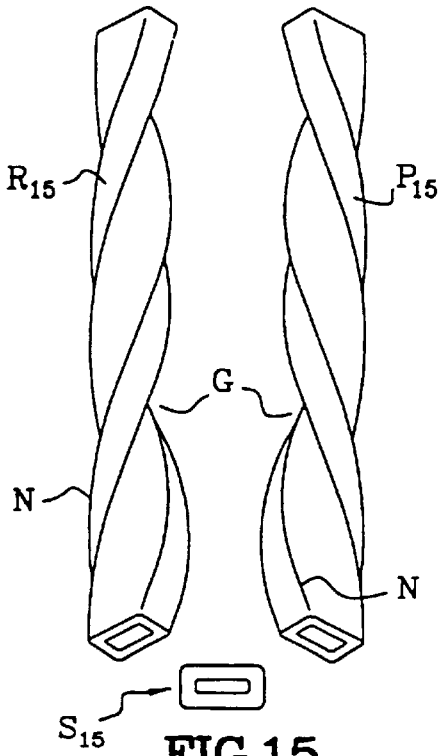
FIG. 15 is a perspective view of two bristles of one of the preferred application devices having a twelfth cross-sectional shape.

FIG. 15 shows two bristles having counterclockwise $P_{15}$ and clockwise $R_{15}$ helical profiles, respectively. The cross-section $S_{15}$ of these bristles is in the shape of a hollow rectangle.

Figure 16:
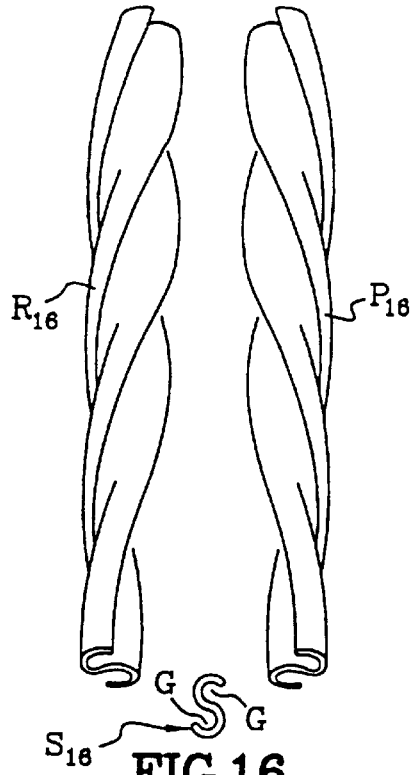
FIG. 16 is a perspective view of two bristles of one of the preferred application devices having a thirteenth cross-sectional shape.

FIG. 16 shows two bristles having counterclockwise $P_{16}$ and clockwise $R_{16}$ helical profiles, respectively. The cross-section $S_{16}$ of these bristles is in the shape of an S.

Figure 17:
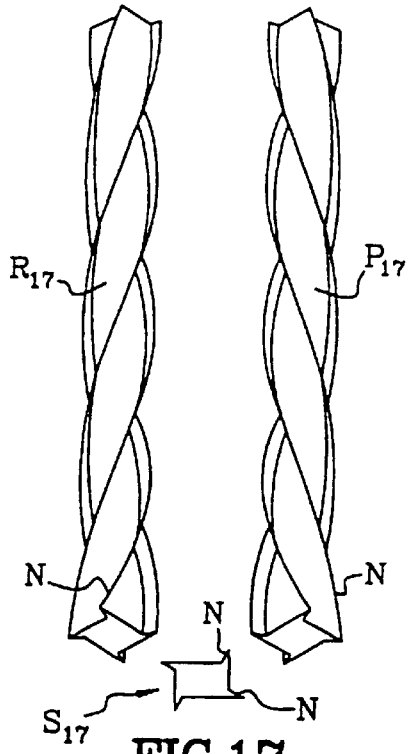
FIG. 17 is a perspective view of two bristles of one of the preferred application devices having a fourteenth cross-sectional shape.

FIG. 17 shows two bristles having counterclockwise $P_{17}$ and clockwise $R_{17}$ helical profiles, respectively. The cross-section $S_{17}$ of these bristles is in the shape of a square with crests N.

Figure 18:
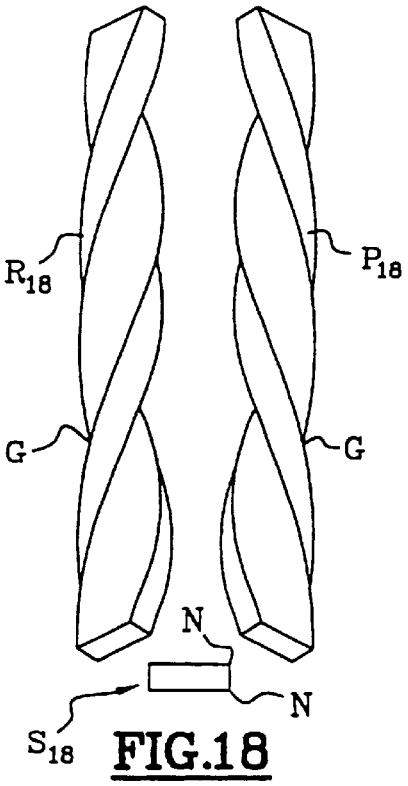
FIG. 18 is a perspective view of two bristles of one of the preferred application devices having a fifteenth cross-sectional shape.

FIG. 18 shows two bristles having counterclockwise $P_{18}$ and clockwise $R_{18}$ helical profiles, respectively. The cross-section $S_{18}$ of these bristles is in the shape of a flattened rectangle.

Figure 19:
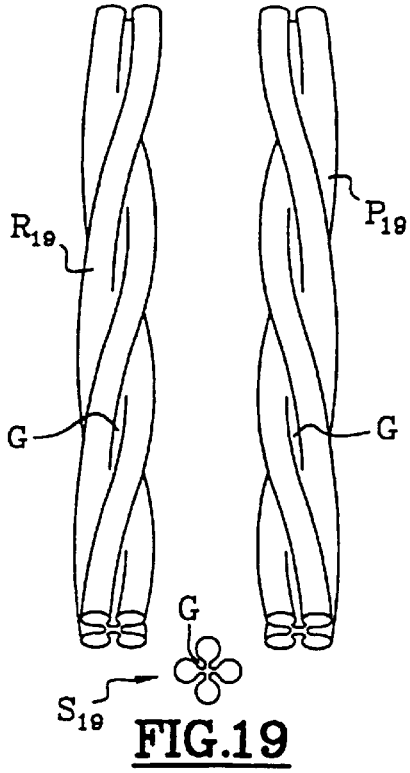
FIG. 19 is a perspective view of two bristles of one of the preferred application devices having a sixteenth cross-sectional shape.

FIG. 19 shows two bristles having counterclockwise $P_{19}$ and clockwise $R_{19}$ helical profiles, respectively. The cross-section $S_{19}$ of these bristles is in the shape of a quatrefoil.

Figure 20:
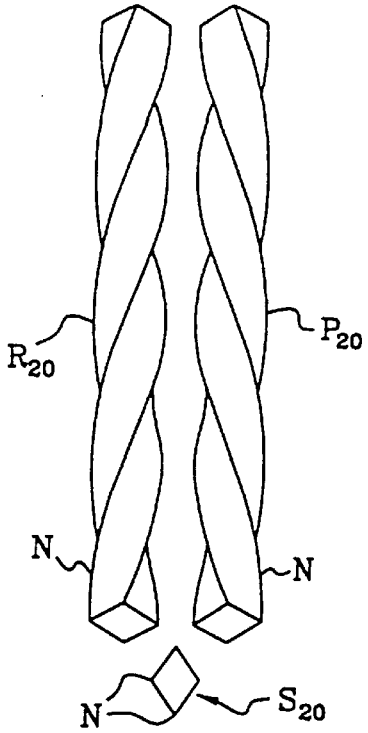
FIG. 20 is a perspective view of two bristles of one of the preferred application devices having a seventeenth cross-sectional shape.

FIG. 20 shows two bristles having counterclockwise $P_{20}$ and clockwise $R_{20}$ helical profiles, respectively. The cross-section $S_{20}$ of these bristles is in the shape of a diamond.

Figure 21:
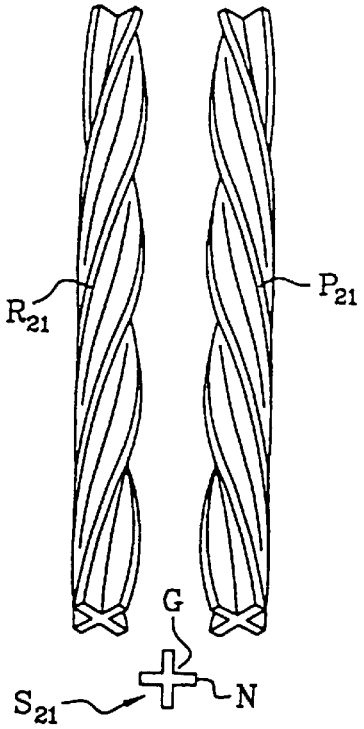
FIG. 21 is a perspective view of two bristles of one of the preferred application devices having an eighteenth cross-sectional shape.

FIG. 21 shows two bristles having counterclockwise $P_{21}$ and clockwise $R_{21}$ helical profiles, respectively. The cross-section $S_{21}$ of these bristles is in the shape of a cruciform.

Figure 22:
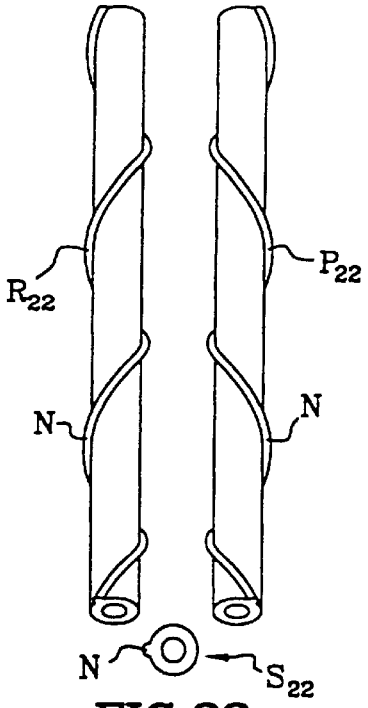
FIG. 22 is a perspective view of two bristles of one of the preferred application devices having a nineteenth cross-sectional shape.

FIG. 22 shows two bristles having counterclockwise $P_{22}$ and clockwise $R_{22}$ helical profiles, respectively. The cross-section $S_{22}$ of these bristles is in the shape of a circle with a bead (i.e., ridge) N.

Figure 23:
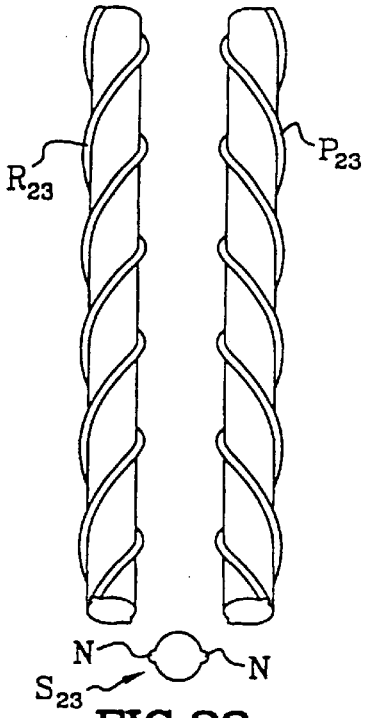
FIG. 23 is a perspective view of two bristles of one of the preferred application devices having a twentieth cross-sectional shape.

FIG. 23 shows two bristles having counterclockwise $P_{23}$ and clockwise $R_{23}$ helical profiles, respectively. The cross-section $S_{23}$ of these bristles is in the shape of a circle with two opposed beads (ridges) N.

Figure 24:
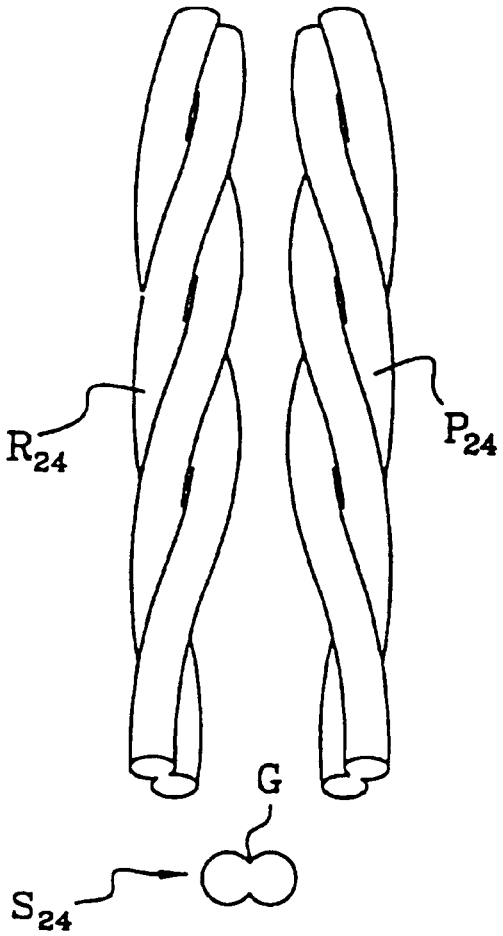
FIG. 24 is a perspective view of two bristles of one of the preferred application devices having a twenty-first cross-sectional shape.

FIG. 24 shows two bristles having counterclockwise $P_{24}$ and clockwise $R_{24}$ helical profiles, respectively. The cross-section $S_{24}$ of these bristles is in the shape of a figure-8.

Figure 25:
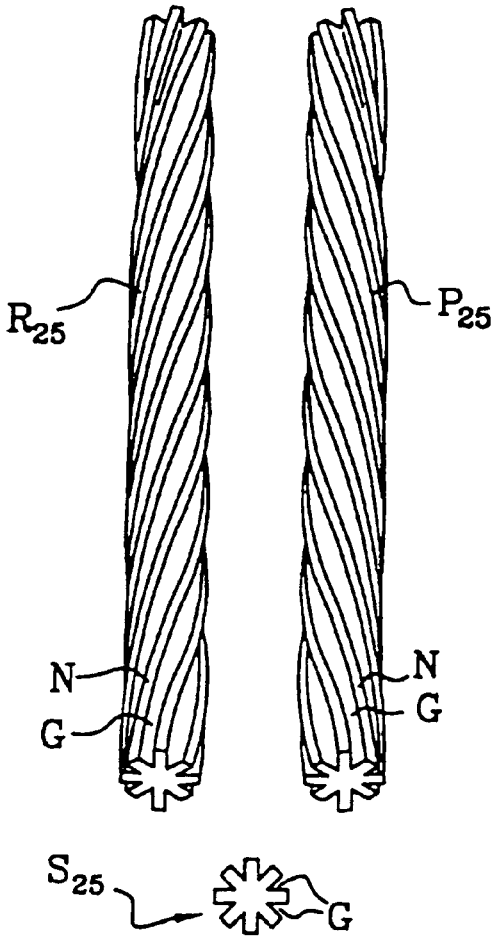
FIG. 25 is a perspective view of two bristles of one of the preferred application devices having a twenty-second cross-sectional shape.

FIG. 25 shows two bristles having counterclockwise $P_{25}$ and clockwise $R_{25}$ helical profiles, respectively. The cross-section $S_{25}$ of these bristles is in the shape of a star.

These bristles of helical profile can be obtained, for example, by extruding a thermoplastic material through a nozzle of an appropriate profile, then hot-twisting the extruded material to the right or to the left about its axis with the pitch and helical direction of the desired helical profile.

Preferably, the cross-section of the above bristles lies inside a circle, the diameter of which ranges from about $^{6}/_{100}$ *ths* of a mm to about $^{30}/_{100}$ *ths* of a mm.

The bristles may be made of a material comprising at least one of polyamide (e.g., PA-6, PA-6,6, PA-11, PA-6,10, PA-6,12), polyester, polyethylene, polypropylene, polyvinyl chloride, polytetrafluoroethylene, polyethylene terephthalate, or thermoplastic elastomer. If appropriate, slip enhancers, such as graphite, molybdenum disulphide, or teflon, may be incorporated into these materials.

The bristles used according to the present invention may be obtained by a method similar to the one described in WO 97/10374 referred to above.

Application devices of the present invention may comprise a mixture of twisted left-handed and right-handed bristles of different types, as defined above. These bristles may be mixed, also, with untwisted bristles of any type known in the art.

Combining bristles of non-cylindrical cross-section and of left-handed and right-handed helical profile twisted about their axis allows for a considerable increase in the product retention capacity, particularly in the gaps formed between the bristles.

It should be appreciated that the mixture of bristles of helical profile may also contain a quantity of untwisted bristles, of a cross-section well-known in the prior art. By way of example, mention may be made of cross-sections which are flat or are in the shape of a circle, a polygon, trilobal, quadrilobal, an L, a C, a U, etc. These untwisted bristles may also be solid or hollow, for example, hollow cylindrical.

In addition, as shown in FIGS. 26–29, the bristles of the application devices of the invention may include free end portions having one or more of a variety of shapes. For example, FIG. 26 shows a bristle with a tapered end. FIG. 27 illustrates a bristle having a rounded end. FIG. 28 shows one example of a bristle having a forked end. In addition, other examples of forked-end bristle are illustrated and described in U.S. Pat. No. 5,020,551. The '551 patent also shows other alternative bristle ends that could be used with the application device of this invention. FIG. 29 illustrates a bristle with a pinhead-shaped, or rounded nailhead, end. U.S. Pat. No. 5,197,497 shows and describes bristles having a pinhead, or rounded nailhead, end.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. An application device comprising:

a stem; and an application element on the stem, the application element including a plurality of bristles, wherein the plurality of bristles include at least one first bristle having a counterclockwise helical profile extending over at least a portion of a length of the at least one first bristle, and at least one second bristle having a clockwise helical profile extending over at least a portion of a length of the at least one second bristle.

2. The application device of claim 1, wherein the application element is attached to the stem.

3. The application device of claim 1, wherein the plurality of bristles include a plurality of first bristles having the counterclockwise helical profile and a plurality of second bristles having the clockwise helical profile.

4. The application device of claim 1, wherein the plurality of bristles include a plurality of first bristles having a plurality of differing counterclockwise helical profiles and a plurality of second bristles having a plurality of differing clockwise helical profiles.

5. The application device of claim 1, wherein at least one of the plurality of bristles has a cross-section with at least one ridge progressing in a helix about a longitudinal axis of the at least one of the plurality of bristles.

6. The application device of claim 5, wherein a shape of the cross-section is a polygon.

7. The application device of claim 6, wherein the shape of the cross-section is one of a square, a triangle, and a rectangle.

8. The application device of claim 1, wherein at least one of the plurality of bristles has a cross-section with at least one hollow portion progressing in a helix about a longitudinal axis of the at least one of the plurality of bristles.

9. The application device of claim 8, wherein a shape of the cross-section is one of a cruciform, a trilobal, a quadrilobal, a hollow oval, a hollow cylinder, a hollow rectangle, a polygon, a hollow polygon, a figure-8, a C, an S, an E, an F, an H, an I, an L, an N, a W, a V, a T, a Y, a star, and a crescent.

10. The application device of claim 8, wherein the hollow portion is formed on a surface of the at least one of the plurality of bristles.

11. The application device of claim 8, wherein the hollow portion is formed inside the at least one of the plurality of bristles.

12. The application device of claim 8, wherein the hollow portion has a dimension in a cross-section of the bristle such that the ratio between the dimension of the hollow portion and the diameter of a circle inside which the cross-section of the bristle lies ranges from about 1/10 to about 9/10.

13. The application device of claim 8, wherein the hollow portion is configured as a groove, the groove having a depth such that the ratio between the depth of the groove and the diameter of a circle inside which the cross-section of the bristle lies ranges from about 1/10 to about 9/10.

14. The application device of claim 1, wherein at least one of the plurality of bristles has a cross-section with at least one rib progressing in a helix about a longitudinal axis of the at least one of the plurality of bristles.

15. The application device of claim 14, wherein the rib has a height such that the ratio between the height of the rib and the diameter of a circle inside which the cross-section of the bristle lies ranges from about 1/10 to about 9/10.

16. The application device of claim 1, wherein the plurality of bristles extend substantially parallel to one another, one end of the plurality of bristles being fixed to the stem.

17. The application device of claim 16, wherein the application device is configured in the form of a nail varnish brush.

18. The application device of claim 1, further comprising a handle on an end of the stem opposite to the application element.

19. The application device of claim 1, wherein the stem is substantially planar, the application element being arranged in a plane of the stem and oriented transversely with respect to a longitudinal axis of the application device.

20. The application device of claim 19, wherein the plurality of bristles extend substantially parallel to the longitudinal axis of the application device.

21. The application device of claim 19, wherein the device is configured in the form of a mascara brush.

22. The application device of claim 1, wherein the application element includes a core, and the plurality of bristles extend substantially radially from the core.

23. The application device of claim 22, wherein the core includes two twisted-together branches of metal wire.

24. The application device of claim 23, wherein the plurality of bristles are trapped between the twisted-together branches of the core.

25. The application device of claim 22, wherein the device is configured in the form of a mascara brush.

26. The application device of claim 22, wherein the core defines an axis coincident with a central axis of the application element.

27. The application device of claim 1, wherein the plurality of bristles include at least one bristle of a first length and at least one bristle of a second length, greater than the first length.

28. The application device of claim 1, wherein a shape of a free end of at least one of the plurality of bristles is one of rounded, tapered, forked, and pinhead.

29. The application device of claim 1, wherein the clockwise and counterclockwise helical profiles have a pitch ranging from about 1 mm to about 20 mm.

30. The application device of claim 29, wherein the pitch ranges from about 1.5 mm to about 10 mm.

31. The application device of claim 30, wherein the pitch ranges from about 2 mm to about 9 mm.

32. The application device of claim 1, wherein a cross-section of each of the plurality of bristles is sized such that the cross-section fits inside a circle having a diameter ranging from about $^{6}/_{100_{ths}}$ of a mm to about $^{30}/_{100_{ths}}$ of a mm.

33. The application device of claim 1, wherein a length of each of the plurality of bristles ranges from about 2 mm to about 25 mm.

34. The application device of claim 1, wherein the plurality of bristles are made of a material chosen from at least one of polyethylene, polypropene, ethylene/propylene copolymer, polyamide, polyester, polyvinyl chloride, polytetrafluoroethylene, polyethylene terephthalate, and thermoplastic elastomer.

35. An application system comprising:

the application device of claim 1; and a reservoir configured to contain a product capable of being applied with the application device.

36. The application system of claim 35, wherein the reservoir includes an opening and a wiper configured to remove excess product from the application element when the application element is withdrawn from the reservoir.

37. The application system of claim 36, wherein the wiper is configured to remove excess material from the stem.

38. The application system of claim 36, wherein the wiper comprises an elastomeric material and includes at least one passage through which the application element member can pass.

39. The application system of claim 36, wherein the wiper comprises a foam material and includes at least one passage through which the application element member can pass.

40. The application system of claim 36, wherein the wiper includes at least one slit extending across a substantial portion of a cross-section of the wiper.

41. The application system of claim 35, wherein the reservoir contains a quantity of the product, and wherein the product is a cosmetic product.

42. The application system of claim 41, wherein the cosmetic product is one of an eye makeup product and a nail treatment product.

43. The application system of claim 42, wherein the cosmetic product is one of mascara and nail varnish.

44. The application system of claim 35, further comprising a handle on an end of the stem opposite the application element, a portion of the handle being configured to removably cover an opening in the reservoir.

45. A method of applying a product to a surface region, comprising:

providing the application device of claim 1;

placing a product on the application element; and transferring the product from the application element to a surface region.

46. The method of claim 45, wherein the product is an eye makeup product and the surface region includes eyelashes.

47. The method of claim 46, wherein the product is a nail treatment product and the surface region includes at least one of a fingernail and a toenail.

48. The application device of claim 1, wherein at least one of the plurality of bristles has a cross-section with at least one hollow portion inside the at least one of the plurality of bristles, the hollow portion extending along a length of the at least one of the plurality of bristles.

49. The application device of claim 1, wherein at least a portion of the stem is configured to be grasped by a user during application of the product.

50. The application device of claim 1, wherein the plurality of bristles form a single tuft of bristles such that the application device is one of a nail varnish brush, a blusher brush, a lipstick brush, and an eyeliner brush.

* * * * *